US008516986B2

(12) United States Patent
Silvano

(10) Patent No.: US 8,516,986 B2
(45) Date of Patent: Aug. 27, 2013

(54) INTAKE SYSTEM FOR A VEHICLE

(75) Inventor: Peter Silvano, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 741 days.

(21) Appl. No.: 12/720,443

(22) Filed: Mar. 9, 2010

(65) Prior Publication Data

US 2010/0229818 A1 Sep. 16, 2010

Related U.S. Application Data

(60) Provisional application No. 61/158,787, filed on Mar. 10, 2009.

(51) Int. Cl.
*F02M 35/10* (2006.01)

(52) U.S. Cl.
USPC ..... 123/184.53; 181/229

(58) Field of Classification Search
USPC ..... 123/184.53, 184.61, 198 E; 181/224, 181/229
See application file for complete search history.

(56) References Cited

U.S. PATENT DOCUMENTS 4,928,638 A 5/1990 Overbeck
5,216,985 A 6/1993 Brümmer et al.
5,921,214 A * 7/1999 Fujita et al. ..... 123/198 E
6,289,864 B1 9/2001 Vide et al.
7,171,934 B2 * 2/2007 Takabe et al. ..... 123/184.53
2006/0006012 A1 * 1/2006 Khouw et al. ..... 180/68.3
2006/0278192 A1 12/2006 Now
2007/0028884 A1 2/2007 Atsumi

* cited by examiner

*Primary Examiner* — Noah Kamen
*Assistant Examiner* — Hung Q Nguyen
(74) *Attorney, Agent, or Firm* — Mark E. Duell; Rankin Hill & Clark LLP

(57) ABSTRACT

An intake tube for an air intake system of a vehicle is provided. The air intake system is located upstream of an intake manifold and includes an intake enclosure and an air precleaner. The intake tube directs a flow of air from the intake enclosure to the air precleaner. The intake tube comprises a first end section, a second end section and a curved section. The first end section is connected to the intake enclosure and has a first longitudinal axis. An inner surface of the first end section defines a first section air passage. The second end section is connected to the air precleaner and has a second longitudinal axis. The inner surface of the second end section defines a second section air passage. The curved section is located between the first and second end sections. The curved section has a third longitudinal axis. An inner surface of the curved section defines a curved air passage. The curved section includes a compressed portion having a minor dimension and a major dimension. The major dimension is greater than the minor dimension so that the flow of air through the curved air passage has minimal separation which increases flow rate into the air precleaner.

20 Claims, 4 Drawing Sheets

INTAKE SYSTEM FOR A VEHICLE

This application claims the benefit of provisional patent application Ser. No. 61/158,787, filed Mar. 10, 2009, which is incorporated by reference in its entirety herein.

BACKGROUND

The present disclosure generally relates to a vehicle air intake system. More particularly, the present disclosure is directed to an improved air intake tube for an air intake system.

Air intake systems provide necessary air to internal combustion engines to aid in the combustion process. Conventional intake systems either draw air from inside the engine compartment, or they draw air from outside the vehicle via an exterior intake port. The intake port is in communication with an intake tube or duct which directs air into an air precleaner. From the air cleaner, another intake tube or duct can be used to direct air to the vehicle's engine, specifically the engine's intake manifold.

Because the intake system must fit within the compact engine compartments of contemporary vehicles, the intake tube upstream of the air precleaner often includes a sharp curved section located between its inlet and outlet sections. As such, the intake tube often does not have a shape sufficient to inhibit the occurrence of a turbulent flow to enable air taken in through the intake port to be supplied smoothly to the air precleaner. The curved section typically has a generally constant circular cross-sectional shape along any plane taken generally normal to a longitudinal axis of the intake tube. Thus, the curved section has a generally constant diameter along the longitudinal axis. This design can cause airflow separation in the curved section which leads to flow loss and an overall lower flow rate.

BRIEF DESCRIPTION

In accordance with one aspect, an intake tube for an air intake system of a vehicle is provided. The air intake system is located upstream of an intake manifold and includes an intake enclosure and an air precleaner. The intake tube directs a flow of air from the intake enclosure to the air precleaner. The intake tube comprises a first end section, a second end section and a curved section. The first end section is connected to the intake enclosure and has a first longitudinal axis. An inner surface of the first end section defines a first section air passage. The second end section is connected to the air precleaner and has a second longitudinal axis. The inner surface of the second end section defines a second section air passage. The curved section is located between the first and second end sections. The curved section has a third longitudinal axis. An inner surface of the curved section defines a curved air passage. The curved section includes a compressed portion having a minor dimension and a major dimension. The major dimension is greater than the minor dimension so that the flow of air through the curved air passage has minimal separation which increases flow rate into the air precleaner.

In accordance with another aspect, an air intake system of a vehicle comprises an intake enclosure, an air precleaner and an air intake tube. The intake enclosure has an inlet in communication with atmosphere and an outlet. The air precleaner has an inlet and an outlet in communication with an associated intake manifold located downstream of the air precleaner. The intake tube fluidly connects the intake enclosure and the air precleaner. The intake tube includes an inlet section, an outlet section and a curved section. The inlet section is in communication with the intake enclosure outlet. The inlet section defines a first axial centerline. The cross-sectional area along any plane taken generally normal to the first axial centerline is approximately constant. The outlet section is in communication with the air precleaner inlet. The outlet section defines a second axial centerline. The cross-sectional area along any plane taken generally normal to the second axial centerline is approximately constant. The curved section is located between the inlet and outlet sections. The curved section defines a third axial centerline. The curved section is squeezed such that the curved section includes a minor diameter and a major diameter. The cross-sectional area along any plane taken generally normal to the third axial centerline is approximately constant. The flow of air through the inlet tube has minimal separation which increases flow rate and the air entering the air cleaner has a more uniform flow distribution.

In accordance with yet another aspect, a method of preventing flow loss in an air intake system of a vehicle is provided. An intake enclosure is provided for collecting air to be delivered to an intake manifold of the vehicle. An air precleaner is provided downstream of the intake enclosure and is in communication with the intake enclosure. The air precleaner filters the flow of air into the intake manifold. An intake tube is disposed between and fluidly connects the intake enclosure and the air precleaner. The intake tube includes a curved section. The curved section is compressed to prevent airflow separation through the curved section. An approximately constant cross-sectional area is maintained along any plane taken generally normal to a longitudinal axis defined by the curved section so that the air entering the precleaner has a uniform flow distribution.

DETAILED DESCRIPTION

Figure 1:
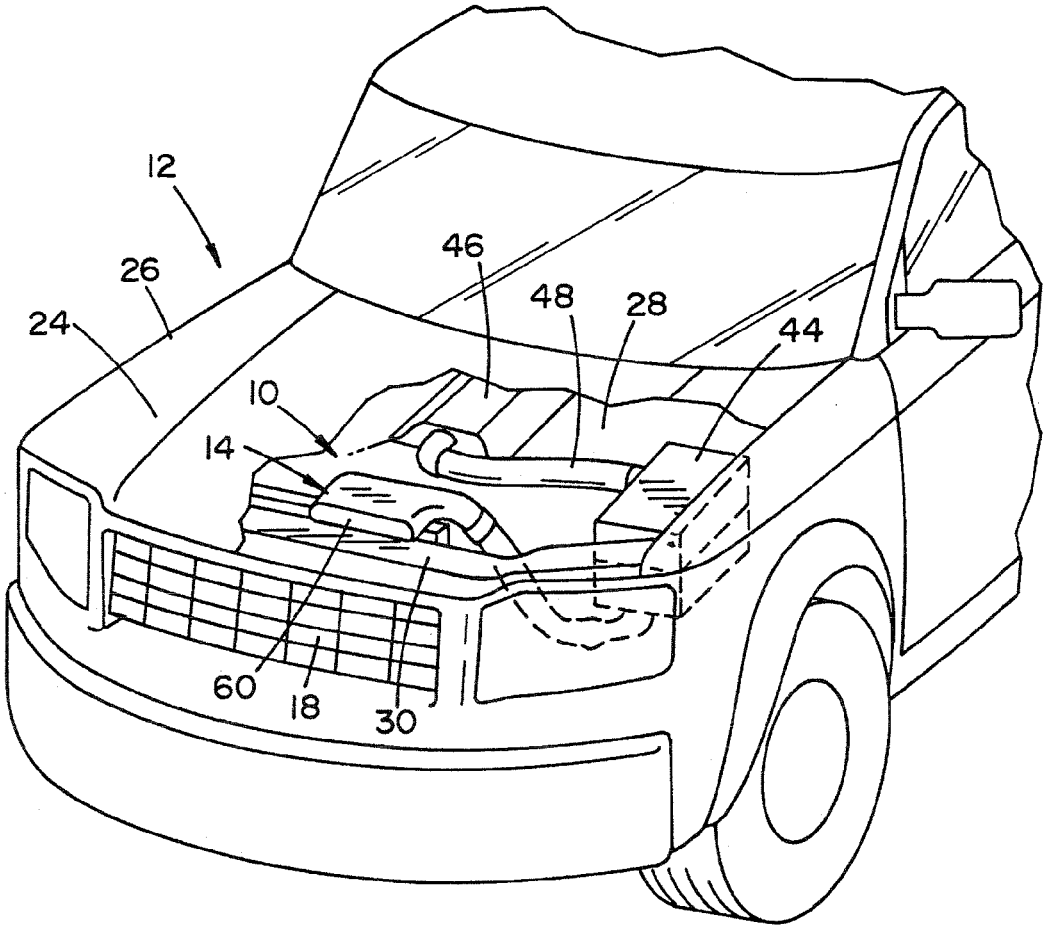
FIG. 1 is a partial front perspective view of a vehicle with its hood partially broken away illustrating an air intake system including an intake tube upstream of an air precleaner.

It should, of course, be understood that the description and drawings herein are merely illustrative and that various modifications and changes can be made in the structures disclosed without departing from the present disclosure. It will also be appreciated that the various identified components of the air intake system disclosed herein are merely terms of art that may vary from one manufacturer to another and should not be deemed to limit the present disclosure. All references to direction and position, unless otherwise indicated, refer to the orientation of the air intake system illustrated in the drawings and should not be construed as limiting the claims appended hereto.

Figure 2:
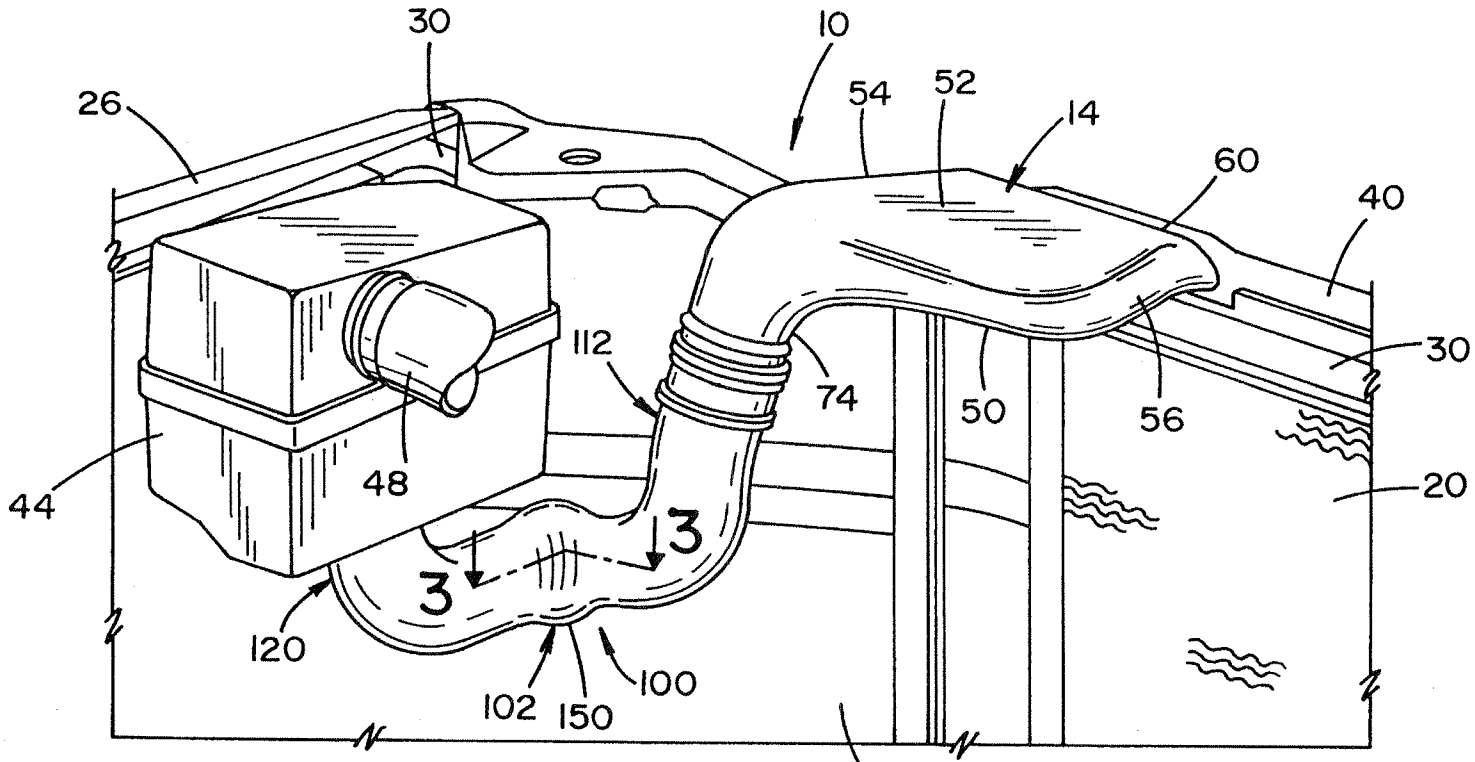
FIG. 2 is a partial rear perspective view of the air intake system of FIG. 1 as viewed from within an engine compartment with the hood in an open position.

Referring now to the drawings, wherein like numerals refer to like parts throughout the several views, FIGS. 1 and 2 illustrate an air intake system 10 according to the present disclosure as part of a vehicle 12. As shown, the air intake system 10 generally includes an air intake enclosure 14 disposed immediately above a grill 18 and a radiator 20 of the vehicle 12 and adjacent a forward portion of the vehicle's hood 24. The air intake system 10 provides cooler air from outside an engine compartment 28 to a vehicle engine while deterring the ingress of particles and water contained in the air from being drawn into the air intake enclosure 14.

The vehicle 12 includes a frame 26 forming boundaries of the engine compartment 28. Disposed across the front of the engine compartment is a frame element commonly referred to as the bulkhead 30. As is well known, the bulkhead 30 is generally a structural frame member, such as a U-shaped steel bar, that traverses a front region of the engine compartment 28 along a top region thereof. As shown, the bulkhead 30 can extend across the engine compartment 28 immediately above the radiator 20. The air intake enclosure 14 can be disposed above the bulkhead and can be attached directly to the bulkhead (or to a bulkhead cover 40), and/or to other structures via hardware such as bolts and/or other common connectors and/or fasteners.

As shown in FIG. 2, the air intake enclosure 14 provides an air inlet that leads to an air filter unit or precleaner 44. The air precleaner 44 generally houses a filter (not shown) and further channels filtered air to an intake manifold 46 of the engine located downstream of the air precleaner. More particularly, the air precleaner 44 filters intake air provided by the intake enclosure 14 and passes the filtered air to the intake manifold 46 via an intake manifold pipe 48. The air intake enclosure 14 generally includes a base wall 50 opposed by a top wall 52, and a pair of opposing sidewalls 54 and 56, which together form a channel for channeling air along an airflow path to the air precleaner 44. Formed at a front portion of the air intake enclosure 14 is an intake port 60, which generally faces toward the front of the vehicle 12. The intake port 60 is in communication with atmosphere and can be configured as illustrated to reduce airflow velocity which, in turn, reduces the possibility of drawing in water and particles in the air.

In particular, the air intake enclosure 14 is shaped and adapted to extend over the radiator 20, which can be disposed below and slightly behind the bulkhead 30. The rearward offset of the radiator 20 from the bulkhead 30 can reduce turbulence, reduce the absorption of heat from the radiator 20 by intake air, and provide space for the intake port 60 on a top of the bulkhead 30 by allowing the bulkhead to be lower than the top of the radiator 20. This can also provide space for the intake port 60 without significantly increasing the height of the hood 24, if at all.

Figure 6:
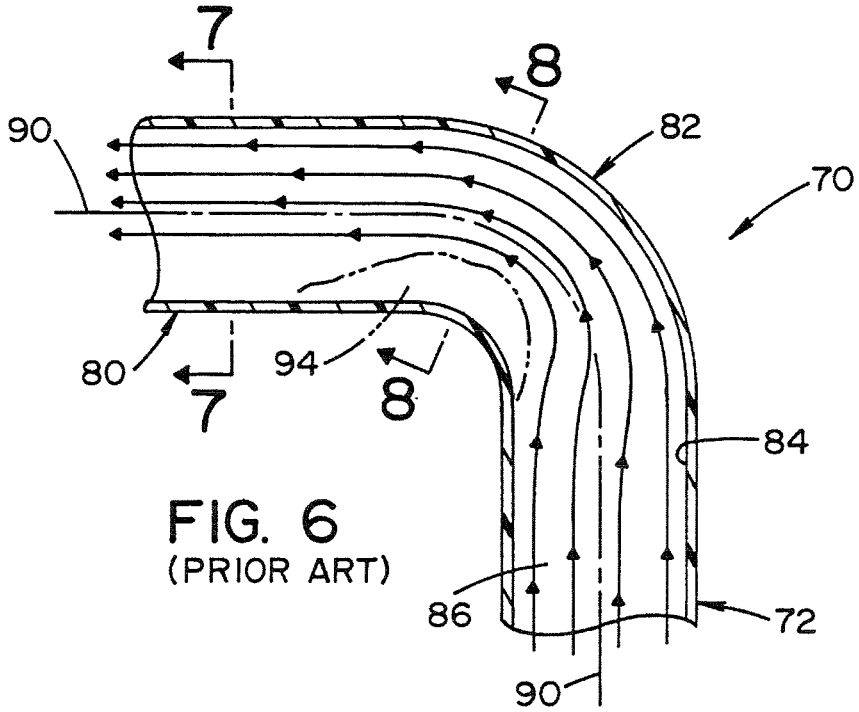
FIG. 6 (PRIOR ART)
FIG. 6 is a partial cross-sectional view of a prior art intake tube for the air intake system of FIG. 1.
Figure 7:
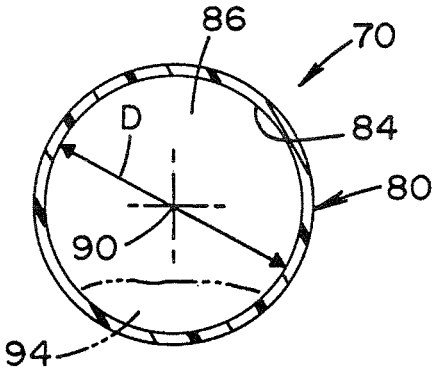
FIG. 7 (PRIOR ART)
FIG. 7 is a cross-sectional view of the prior art intake tube taken generally along line 7-7 of FIG. 6.
Figure 8:
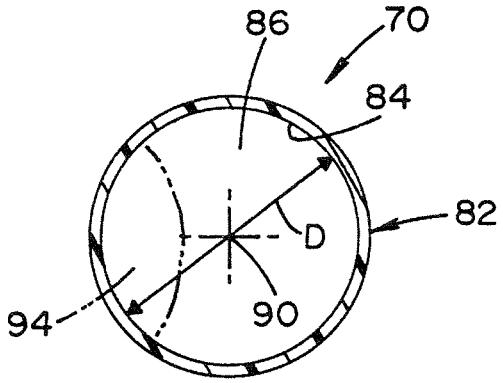
FIG. 8 (PRIOR ART)
FIG. 8 is a cross-sectional view of the prior art intake tube taken generally along line 8-8 of FIG. 6.

As will be described in more detail herein, an intake tube directs a flow of air from the intake enclosure 14 to the air precleaner 44. With reference to FIGS. 6-8, a conventional intake tube 70 is illustrated. A first end section or inlet section 72 of the intake tube 70 is connected to an outlet 74 (FIG. 2) of the air intake enclosure 14. A second end section or outlet section 80 is connected to an inlet (not shown) of the air precleaner 44. A curved section 82 is located between the inlet and outlet sections 72, 80. Curved sections, such as section 82, are often employed in intake systems for enabling the intake tube 70 to fit within the confines of ever-smaller engine components.

The conventional intake tube 70 includes an inner surface 84 which defines an air passage 86 longitudinally or axially through the intake tube 70. The intake tube 70 further defines a longitudinal axis or axial centerline 90 extending along its entire axial extent (i.e., along the air passage 86). As shown in FIGS. 7 and 8, the cross-sectional shape along any plane taken generally normal to the longitudinal axis 90 of the intake tube 70 is generally axisymmetrical. Thus, the cross-sectional area along any plane taken generally normal to the longitudinal axis 90 is approximately constant. As indicated previously, because the air intake system 10 must fit within the compact engine compartment 28, the conventional intake tube 70 does not have a shape sufficient to inhibit occurrence of a turbulent flow along or as a result of the curved section 82 to enable air taken in through the intake enclosure 14 to be supplied smoothly to the air precleaner 44. Moreover, because the intake tube 70 has a generally constant dimension through the inlet, outlet and curved sections (i.e., a constant cross-sectional area), the airflow in the curved section 82 can separate, particularly from the inner surface 84 of the curved section. This separation area 94 (which can include random eddies, vortices and other flow fluctuations) reduces the airflow cross-sectional area, which, in turn, leads to flow loss and an overall lower flow rate resulting in a lower volume of air being delivered to the intake manifold 46. The depicted prior art intake tube 70 has a generally circular cross-sectional area (i.e. a generally constant diameter D through the inlet, outlet and curved sections). It is also known that the intake tube can have a generally rectangular or elliptical constant cross-sectional areas through the inlet, outlet and curved sections. The airflow in the curved section of this prior art intake tube can also separate.

Figure 3:
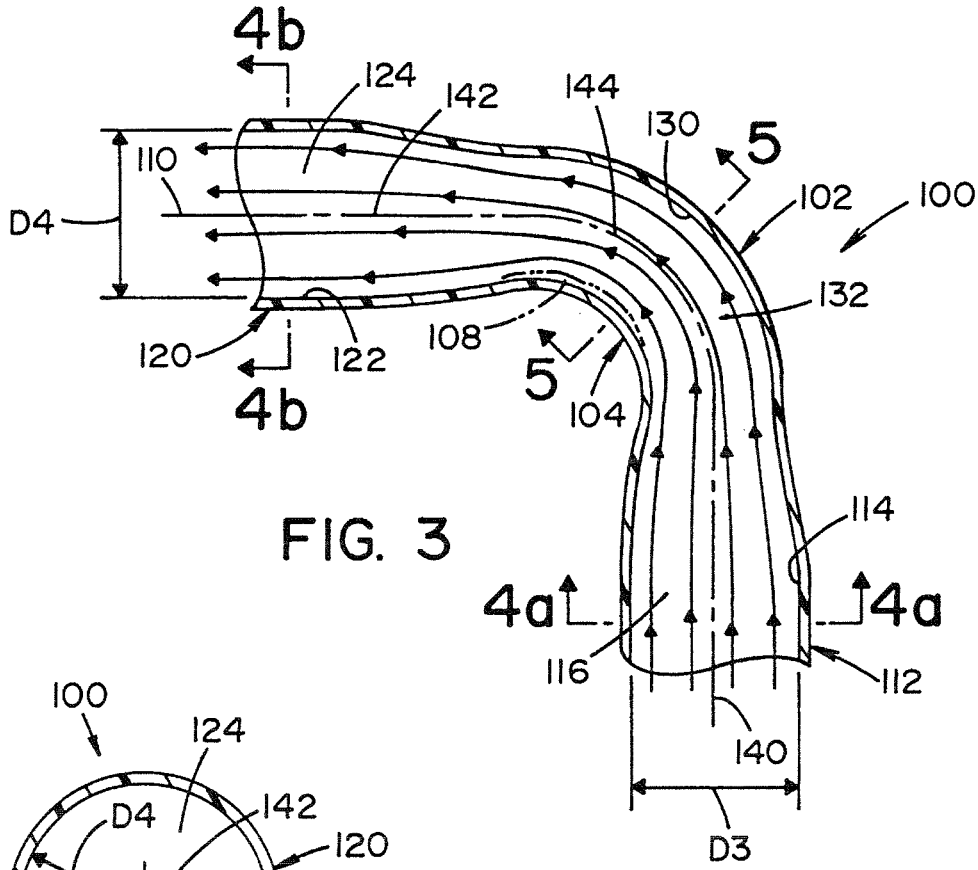
FIG. 3 is a partial cross-sectional view of the intake tube of the air intake system of FIG. 2 taken generally along line 3-3 of FIG. 2.
Figure 4B:
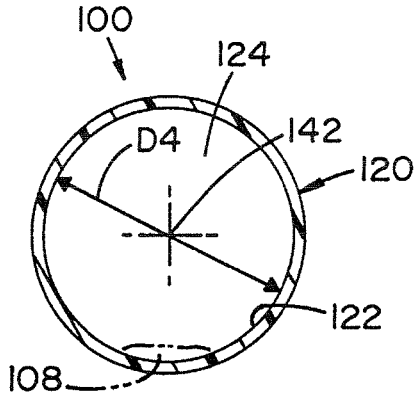
FIG. 4*b* is a cross-sectional view of the intake tube taken generally along line 4*b*-4*b* of FIG. 3.
Figure 4A:
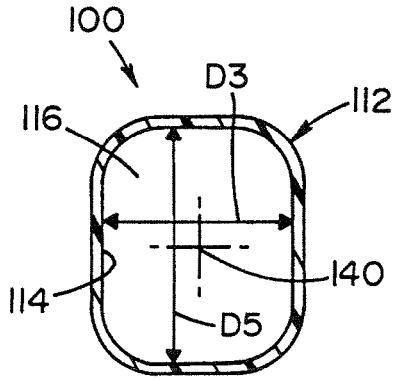
FIG. 4*a* is a cross-sectional view of the intake tube taken generally along line 4*a*-4*a* of FIG. 3.
Figure 5:
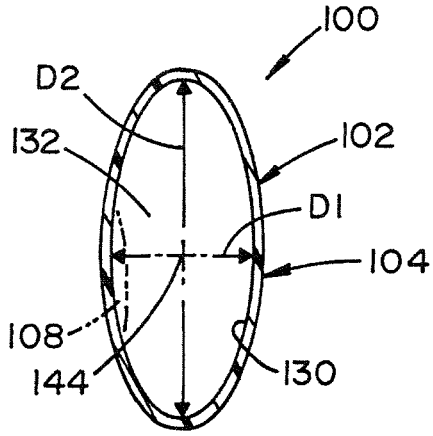
FIG. 5 is a cross-sectional view of the intake tube taken generally along line 5-5 of FIG. 3.

With reference to FIGS. 3-5, and as will be explained in greater detail below, an improved intake tube 100 according to the present disclosure prevents or at least substantially reduces airflow separation along its curved section (or resulting from its curved section) by squeezing or compressing a dimension of the curved section into a minor dimension and a major dimension. More particularly, the intake tube 100 includes a curved section 102 having a compressed portion 104 with a minor dimension and a major dimension. The major dimension can be controlled along a longitudinal axis or axial centerline 110 defined by the intake tube 100. As such, a cross-sectional area along any plane taken generally normal to the longitudinal axis 110 remains approximately constant. This allows the flow of air through the curved section 102 to have minimal separation, particularly in contrast to curved section 82 of the prior art intake tube 70. In the depicted embodiment of FIG. 5, the compressed portion includes a minor diameter D1 and a major diameter D2, the minor diameter D1 being less than the major diameter D2. In a preferred embodiment, the major diameter D2 is approximately equal to two and one-third (2.33) times the minor diameter D1. A reduced separation area 108 increases the airflow cross-sectional area of the curved section 102 Thus, the airflow cross-sectional area is more similar or closer to the actual cross-sectional area of the intake tube 100, even along the curved section 102, than the airflow cross-sectional area of prior art tubes (e.g., intake tube 70). As a result, the air entering the air precleaner 44 from the outlet section 120 has a substantially uniform flow distribution or at least a more uniform flow distribution. This, in turn, increases flow rate into the air precleaner 44. The overall effect of an increased flow rate is increased horsepower generation and an improved gas mileage per fuel supply volume for the vehicle's engine.

Similar to the conventional intake tube 70, intake tube 100 directs a flow of air from the intake enclosure 14 to the air precleaner 44. With additional reference to FIG. 2, the intake tube 100 includes a first end section or inlet section 112 connected to the outlet 74 of the air intake enclosure 14 via conventional means or methods. An inner surface 114 of the first end section 112 defines a first air passage 116. A second end section or outlet section 120 of the intake tube 100 is connected to the inlet (not shown) of the air precleaner 44, also via conventional means or methods. An inner surface 122 of the second end section 120 defines a second air passage 124. The curved section 102 is located between the inlet and outlet sections 112, 120. An inner surface 130 of the curved section defines a curved air passage 132. The passages 116, 124, 132 together form an axial or longitudinal passage along and through the entire tube 100.

The longitudinal axis or axial centerline 110 can be separated into or comprised of three axes, to wit, a first longitudinal axis or axial centerline 140 defined by the inlet section 112, a second longitudinal axis or axial centerline 142 defined by the outlet section 120, and a third longitudinal axis or axial centerline 144 defined by the curved section 102. Each of the axes 140, 142, 144 is formed along to a corresponding one of the passages 116, 124, 132. The cross-sectional area of the intake tube 100 along any plane taken generally normal to any one of the first, second and third longitudinal axes 140, 142, 144 is approximately constant. The inlet section 112 has a generally constant dimensions D3 and D5 along the first longitudinal axis 140 and the outlet section 120 has a generally constant dimension D4 along the second longitudinal axis 142. In the depicted embodiment, the dimensions D3 and D4 are equal to one another and to the original dimension D of intake tube 70, although, this is not required. As shown in FIG. 4*a*, the cross-sectional shape along any plane taken generally normal to the first longitudinal axis 140 of the inlet section 112 is generally rectangular and axisymmetrical. As shown in FIG. 4*b*, the cross-sectional shape along any plane taken generally normal to the second longitudinal axis 142 of the outlet section 120 is generally circular and axisymmetrical. Thus, the cross-sectional area along any plane taken generally normal to the first and second longitudinal axes 140, 142 is approximately constant. The cross-sectional area of the inlet section 112 can be substantially equal to the cross-sectional area of the outlet section 120; although, this is not required. It should also be appreciated that the cross-sectional shapes of the inlet and outlet sections 112, 120 can be the same.

As shown in FIG. 5, the cross-sectional shape along any plane taken generally normal to the third longitudinal axis 144 of the compressed portion 104 is generally elliptical (i.e., has a major and a minor diameter). Similar to the inlet and outlet sections 112, 120, the cross-sectional area along any plane taken generally normal to the third longitudinal axis 144 through the curved section 102 can be approximately constant. This is achieved by controlling the major dimension (i.e., major diameter D2) of the compressed portion 104 along the third longitudinal axis 144 to maintain the cross-sectional area. For example, the minor dimension (i.e., minor diameter D1) can correspond to a dimension that eliminates separation of the airflow from the inner surface 122 as the airflow passes through the curved section 102 and the major dimension (i.e., major diameter D2) can be controlled or set relative to the minor dimension (i.e., minor diameter D1) so as to maintain an approximate constant cross-sectional area through the intake tube 100. As a result, the flow of air from the curved air passage 132 into the second air passage 124 is generally laminar with minimal air separation. To further prevent air separation, the cross-sectional area of the outlet section 120 along any plane taken generally normal to the second longitudinal axis 142 is approximately equal to the cross-sectional area of the curved section 102 along any plane taken generally normal to the third longitudinal axis 144.

A bottom point or area 150 (FIG. 2) can be provided along the curved section 102 for allowing any objects or moisture drawn into the air intake enclosure 14 to collect for withdrawal in concert with air filter changes and/or to act as a fluid trap. Optionally, a drain hole (not shown) may be formed in the intake tube (such as at the bottom point 150) to permit the drainage of any moisture drawn into the air intake enclosure 14. Reducing the amount of moisture droplets and particles in intake air increases the life of the air filter disposed in air precleaner 44, provides cleaner air to the intake system and engine, and provides cooler outside air for combustion, which can greatly increase the efficiency of the engine. Similarly, the intake enclosure 14 can be a molded plastic part or can be formed via some other known manufacturing technology.

The intake tube 100 can be a molded plastic unit as is known in the art, which is airtight, generally lightweight, and robust, yet inexpensive to manufacture; however, it can be formed via other known manufacturing technologies, such as from an assembly of metal or plastic components. Similarly, the intake enclosure 14 can be a molded plastic part or can be formed with some other known manufacturing technology.

The present disclosure provides a method of preventing flow loss in the air intake system 10 of a vehicle 12. The intake enclosure 14 is provided for collecting air to be delivered to the intake manifold 46 of the vehicle. As already described, the air precleaner 44 is provided downstream of the intake enclosure 14 and is in communication with the intake enclosure. The air precleaner 44 filters the flow of air into the intake manifold 46. The intake tube 100 is disposed between and fluidly connects the intake enclosure 14 and the air precleaner 44. The intake tube 100 includes the curved section 102 which is compressed to prevent airflow separation through the curved section. A approximately constant cross-sectional area is maintained along any plane taken generally normal to the longitudinal axis 144 defined by the curved section so that the air entering the air precleaner has a uniform flow distribution.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An intake tube for an air intake system of a vehicle, the air intake system being located upstream of an intake manifold and includes an intake enclosure and an air precleaner, the intake tube directing a flow of air from the intake enclosure to the air precleaner, the intake tube comprising:

a first end section connected to the intake enclosure, the first end section having a first longitudinal axis, an inner surface of the first end section defining a first section air passage;

a second end section connected to the air precleaner, the second end section having a second longitudinal axis, an inner surface of the second end section defining a second section air passage; and a curved section located between the first and second end sections, the curved section having a third longitudinal axis, an inner surface of the curved section defining a curved air passage, the curved section including a compressed portion having a minor dimension and a major dimension, the major dimension greater than the minor dimension so that the flow of air through the curved air passage has minimal separation which increases flow rate into the air precleaner.

2. The intake tube of claim 1, wherein the cross-sectional area along any plane taken generally normal to the third longitudinal axis through the curved section is approximately constant.

3. The intake tube of claim 2, wherein the major dimension of the compressed portion is controlled along the third longitudinal axis to maintain the approximately constant cross-sectional area through the curved section.

4. The intake tube of claim 1, wherein the cross-sectional shape along any plane taken generally normal to the third longitudinal axis of the compressed portion is generally elliptical, wherein the cross-sectional area along any plane taken generally normal to the third longitudinal axis through the curved section is approximately constant.

5. The intake tube of claim 4, wherein the cross-sectional shape along any plane taken generally normal to the first longitudinal axis of the first end section is generally rectangular, wherein the cross-sectional area along any plane taken generally normal to the first longitudinal axis through the first end section is approximately constant.

6. The intake tube of claim 4, wherein the cross-sectional shape along any plane taken generally normal to the second longitudinal axis of the second end section is generally circular, wherein the cross-sectional area along any plane taken generally normal to the second longitudinal axis through the second end section is approximately constant.

7. The intake tube of claim 1, wherein the flow of air from the curved air passage into the second air passage is generally laminar.

8. The intake tube of claim 1, wherein the air entering the air precleaner from the second end section has a substantially uniform flow distribution.

9. The intake tube of claim 1, wherein the cross-sectional area of the intake tube along any plane taken generally normal to one of the first, second and third longitudinal axes is approximately constant.

10. An air intake system of a vehicle comprising:

an intake enclosure having an inlet in communication with atmosphere and an outlet;

an air precleaner having an inlet and an outlet in communication with an associated intake manifold located downstream of the air precleaner; and an intake tube fluidly connecting the intake enclosure and the air precleaner, the intake tube including:

an inlet section in communication with the intake enclosure outlet, the inlet section defining a first axial centerline, the cross-sectional area along any plane taken generally normal to the first axial centerline being approximately constant;

an outlet section in communication with the air precleaner inlet, the outlet section defining a second axial centerline, the cross-sectional area along any plane taken generally normal to the second axial centerline being approximately constant; and a curved section located between the inlet and outlet sections, the curved section defining a third axial centerline, the curved section being squeezed such that the curved section includes a minor diameter and a major diameter, the cross-sectional area along any plane taken generally normal to the third axial centerline being approximately constant, wherein the flow of air through the inlet tube has minimal separation which increases flow rate and the air entering the air cleaner has a more uniform flow distribution.

11. The intake tube of claim 10, wherein the major diameter of the curved section is controlled along the third axial centerline to maintain the approximately constant cross-sectional area through the curved section.

12. The intake tube of claim 10, wherein the cross-sectional shape along any plane taken generally normal to the third axial centerline of the curved section is generally elliptical.

13. The intake tube of claim 12, wherein the cross-sectional shape along any plane taken generally normal to the first axial centerline of the inlet section is generally rectangular and the cross-sectional shape along any plane taken generally normal to the second axial centerline of the outlet section is generally circular.

14. The intake tube of claim 13, wherein the inlet section has a generally constant first dimension along the first axial centerline and the outlet section has a generally constant second dimension along the second axial centerline.

15. The intake tube of claim 10, wherein the cross-sectional area of the inlet section along any plane taken generally normal to the first axial centerline is approximately equal to the cross-sectional area of the outlet section along any plane taken generally normal to the second axial centerline.

16. The intake tube of claim 10, wherein the cross-sectional area of the outlet section along any plane taken generally normal to the second axial centerline is approximately equal to the cross-sectional area of the curved section along any plane taken generally normal to the third axial centerline.

17. A method of preventing flow loss in an air intake system of a vehicle, the method comprising:

providing an intake enclosure for collecting air to be delivered to an intake manifold of the vehicle;

providing an air precleaner downstream of the intake enclosure and in communication with the intake enclosure, the air precleaner filtering the flow of air into the intake manifold;

providing an intake tube, the intake tube disposed between and fluidly connecting the intake enclosure and the air precleaner, the intake tube including a curved section;

compressing the curved section to prevent airflow separation through the curved section; and maintaining an approximately constant cross-sectional area along any plane taken generally normal to a longitudinal axis defined by the curved section so that the air entering the precleaner has a uniform flow distribution.

18. The method of claim 17, further comprising compressing an original dimension D of the curved section to a minor dimension D1 and a major dimension D2, the minor dimension D1 being less than the major dimension D2, and controlling the major dimension D2 of the curved section along the longitudinal axis so that the cross-sectional area of the curved section remains approximately constant.

19. The method of claim 18, further comprising compressing the curved section into a generally elliptical cross-sectional shape.

20. The method of claim 17, further comprising maintaining an approximately constant cross-sectional area along any plane taken generally normal to a longitudinal axis defined by each of an outlet section of the inlet tube and an inlet section of the inlet tube, the outlet and inlet sections flanking the curved section.

* * * * *